US005145409A

United States Patent [19]

Sato et al.

[11] Patent Number: 5,145,409

[45] Date of Patent: Sep. 8, 1992

[54] MINIATURE ELECTRICAL CONNECTOR

[75] Inventors: Kensaku Sato; Hitoshi Miyahira; Tadayasu Iwasawa, all of Tokyo, Japan

[73] Assignee: Hirose Electric Co., Ltd., Tokyo, Japan

[21] Appl. No.: 712,908

[22] Filed: Jun. 7, 1991

[30] Foreign Application Priority Data

Oct. 9, 1990 [JP] Japan ..... 2-93964[U]

[51] Int. Cl.[5] ..... H01R 17/04

[52] U.S. Cl. ..... 439/585; 439/610

[58] Field of Search ..... 439/578–585, 439/675, 98, 877, 607, 609, 610

[56] References Cited

U.S. PATENT DOCUMENTS

| | | | |
|---|---|---|---|
| 3,670,293 | 6/1972 | Garver | 439/585 |
| 3,728,787 | 4/1973 | McDonough | 439/585 |
| 4,010,538 | 3/1977 | O'Keefe et al. | 439/585 |
| 4,269,469 | 5/1981 | Qudic | 439/585 |

*Primary Examiner*—David L. Pirlot

*Attorney, Agent, or Firm*—Kanesaka & Takeuchi

[57] ABSTRACT

A miniature electrical contact terminal includes a shield jacket (3) having a contact support section (6), a shield braid crimping section (7) with a pair of crimping tabs to be crimped to a shield braid (22) of a shield cable (2), and an outer sheath crimping section (8) with a pair of crimping tabs to be crimped to an outer sheath (23) of the shielded cable; an insulator block (4) to be fitted in the contact support section; and a signal line contact (5) fitted through the insulator block such that a terminal section (15) project from a rear end of the insulator block.

2 Claims, 4 Drawing Sheets

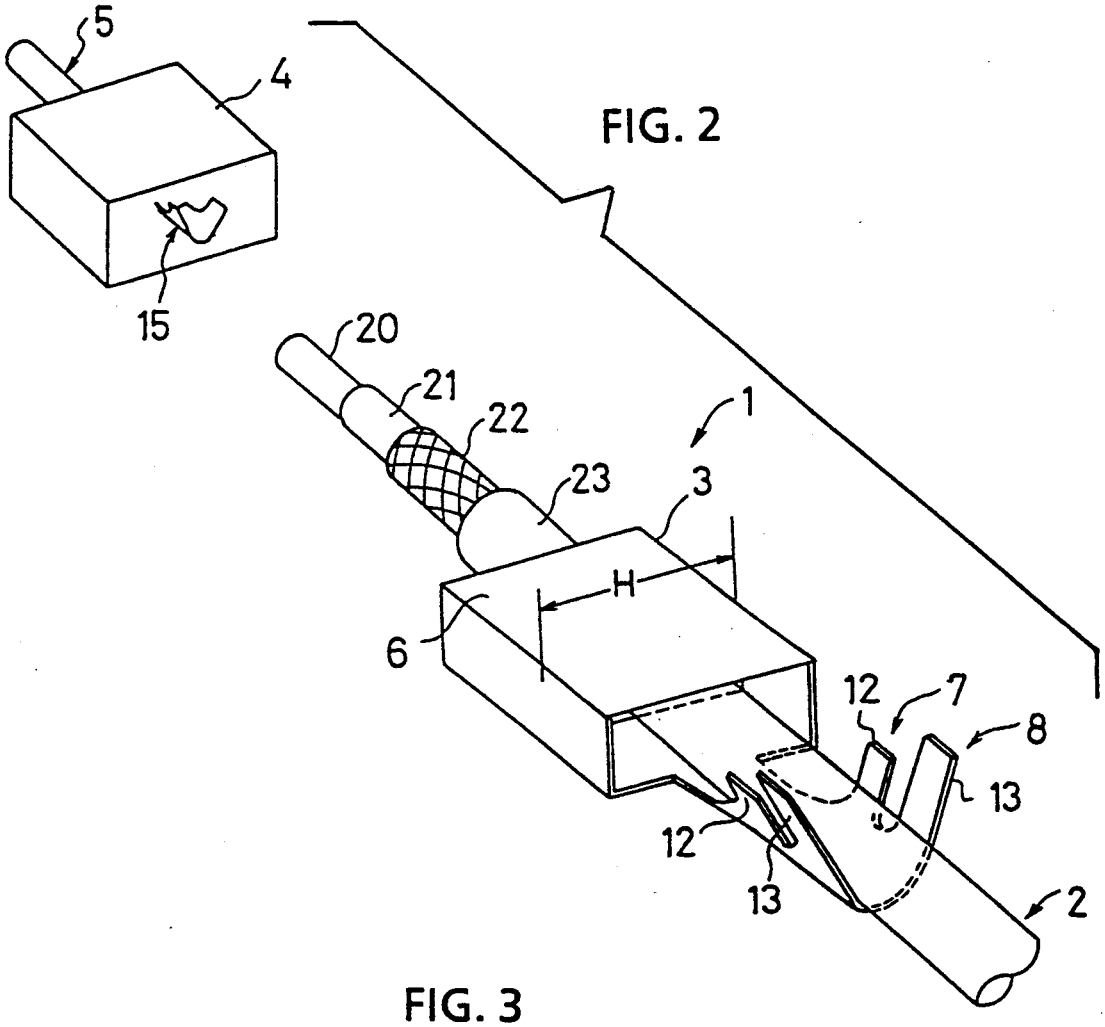
FIG. 2
FIG. 3
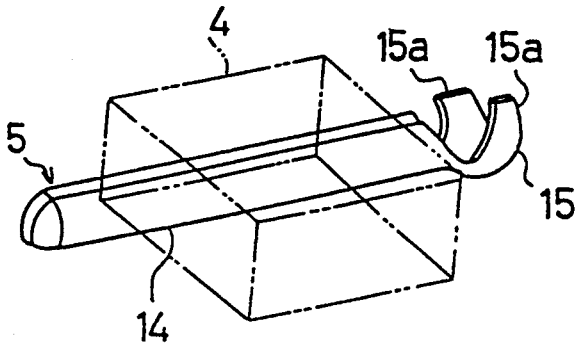

MINIATURE ELECTRICAL CONNECTOR

BACKGROUND OF THE INVENTION

1. Field of the Invention

The present invention relates to miniature electrical connectors for shielded cables for use in electronic control units or the like.

2. Description of the Prior Art

FIG. 7 shows a conventional electrical connector of the type, wherein a front portion of the outer sheath g of a shielded cable a is removed to separate a signal line c from a shield braid b. The shield braid b and the signal line c are connected by insulation displacement, for example, to respective contact terminals e and f of a connector proper d.

In the above conventional electrical connector, however, it is necessary to separately connect the shield braid b and the signal line c to the contact terminals e and f, making the streamlining and automation of the wiring operation difficult. In addition, the signal line c is stripped of the shield braid b near the connector proper d so that there is little or no shield effect near the connector proper d.

SUMMARY OF THE INVENTION

Accordingly, it is an object of the invention to provide a miniature electrical contact terminal having better shield effect.

It is another object of the invention to provide a miniature electrical contact terminal having a narrow shield jacket.

According to the invention there is provided a miniature electrical contact terminal which includes a shield jacket having a contact support section, a shield braid crimping section with a pair of crimping tabs to be crimped to a shield braid of a shield cable, and an outer sheath crimping section with a pair of crimping tabs to be crimped to an outer sheath of the shielded cable; an insulator block to be fitted in the contact support section; and a signal line contact fitted through the insulator block such that a terminal section project from a rear end of the insulator block.

A shielded cable is connected to the miniature electrical contact terminal by a method which includes inserting a stripped front portion of the shielded cable through the shield jacket; connecting the signal line to the terminal section of the signal line contact; fitting the insulator block in the shield jacket; and crimping the shield braid crimping section and the outer sheath crimping section to a shield brain and an outer sheath of the shielded cable, respectively, whereby the shielded cable is connected to the miniature contact terminal.

The above and other objects, features, and advantages of the invention will be more apparent from the following description when taken in conjunction with the accompanying drawings.

BRIEF DESCRIPTION OF THE DRAWINGS

FIG. 2 is an exploded perspective view of a contact terminal useful for the electrical connector;

FIG. 3 is a perspective view of a signal line contact useful for the electrical connector;

DESCRIPTION OF THE PREFERRED EMBODIMENT

Figure 8:
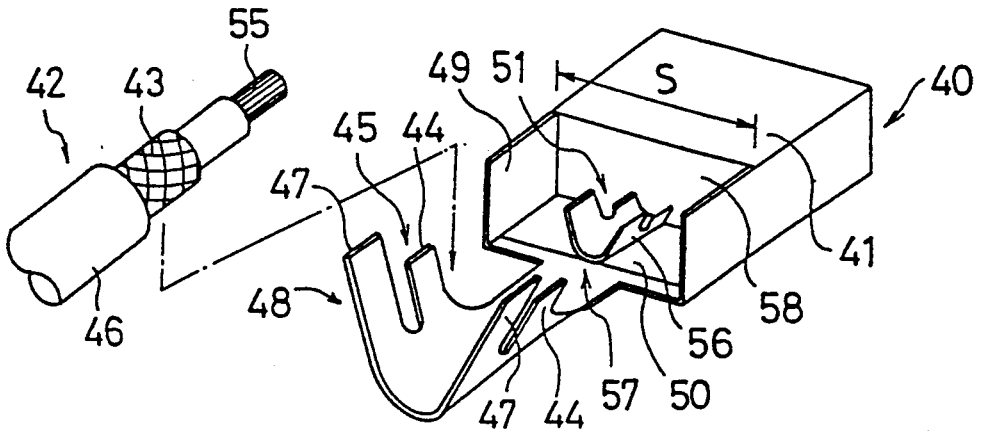
FIG. 8 is a perspective view of an electrical contact terminal according to another embodiment of the invention.

FIG. 8 shows an electrical contact terminal which is suitable for the streamlined and mechanized wiring operation and has a good shield effect. The shield jacket 40 has a rectangular contact support section 41, a U-shaped shield braid crimping section 45 having a pair of crimping tabs 44 to be crimped to the shield braid 43 of a shield cable 42, and a U-shaped outer sheath crimping section 48 having a pair of crimping tabs 47 to be crimped to the outer sheath 46 of the shielded cable 42. The contact support section 41 has a pair of tool openings 49 and 50. The signal line contact 51 has a U-shaped signal line crimping section 57 with a pair of crimping tabs 56 to be crimped to the signal line 55 of the shielded cable 42. A rectangular insulator block 58 is fitted in the contact support section 41 to support the signal line contact 51, providing a finished contact terminal.

Figure 9:
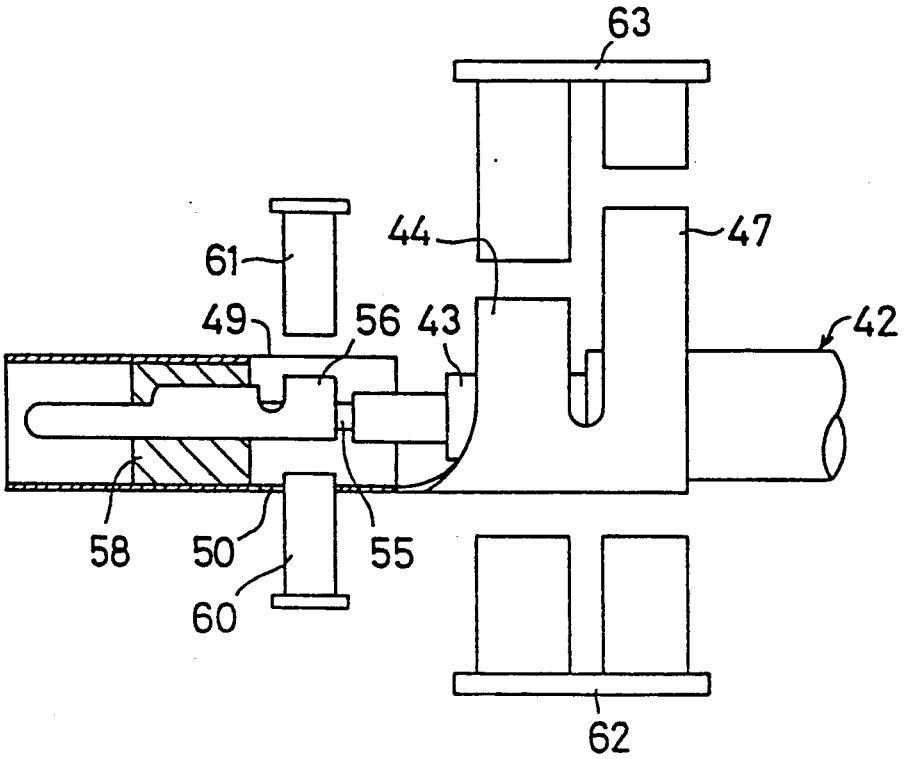
FIG. 9 is a side elevational view, partially in section, of the contact terminal useful for explaining how to connect a shielded cable to the contact terminal.

In FIG. 9, the front portion of the shielded cable 42, which has been stripped of the outer sheath 46, is placed on the contact terminal such that the signal line 55, the shield braid 43, and the outer sheath 46 rest between the respective crimping tabs 56, 44, and 47. A crimping anvil 60 and a crimper die 61 are then inserted through the tool openings 50 and 49 to crimp the crimping tabs 56 to the signal line 55 while a crimping anvil 62 and a crimper die 63 are used to crimp the crimping tabs 44 and 47 to the shield braid 43 and the outer sheath 46, respectively.

Figure 10:
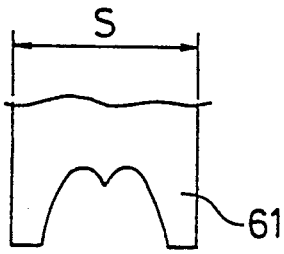
FIG. 10 is a front elevational view of a crimper die for crimping the contact terminal to a shielded cable.

However, the crimping anvil 60 and the crimping die 61 are so large that it is impossible to miniaturize the tool opening 49. That is, the minimum width of the shield jacket 40 is as large as the width S of the crimping die 6 (FIG. 10), putting a limit to the miniaturization of the contact terminal and thus the electrical connector.

Figure 1:
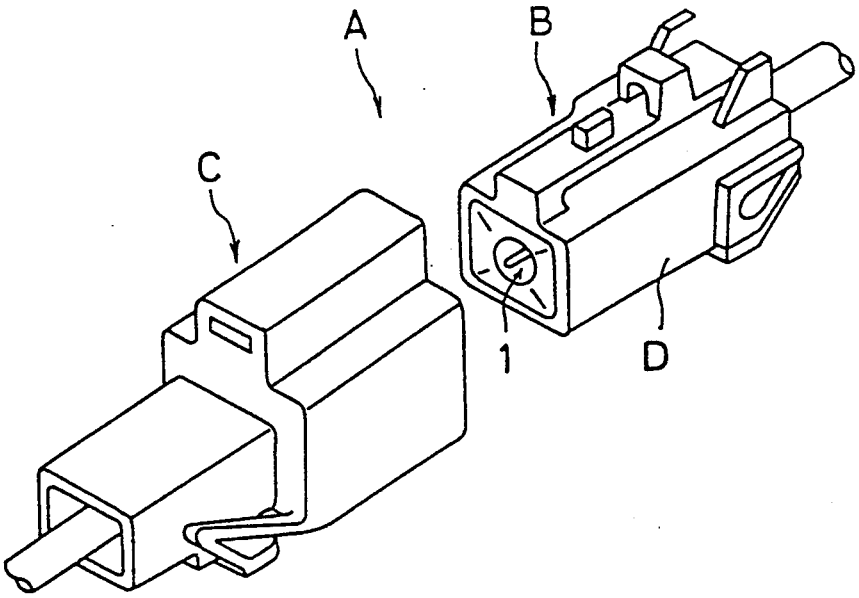
FIG. 1 is an electrical connector according to an embodiment of the invention.
Figure 7:
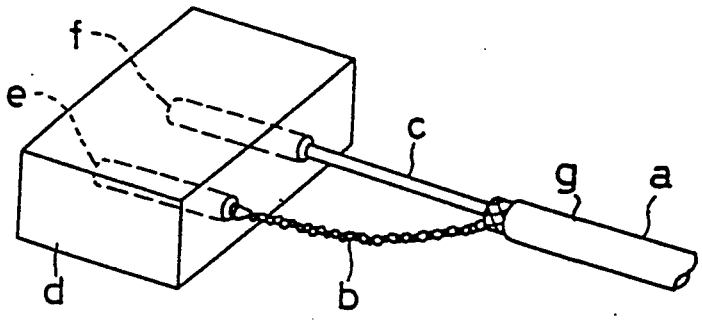
FIG. 7 PRIOR ART
FIG. 7 is a perspective view of a conventional electrical connector.

FIG. 1 shows a miniature electrical connector A which consists of a female connector B and a male connector C. The female connector B has a miniature contact terminal 1 within the housing D.

In FIG. 2, the miniature contact terminal 1 consists of a narrow shield jacket 3, an insulator block 4, and a signal line contact 5. The shield jacket 3 has a rectangular contact support section 6, a U-shaped shield braid (outer conductor) crimping section 7, and a U-shaped outer sheath crimping section 8. The shield braid crimping section 7 has a pair of crimping tabs 12 while the outer sheath crimping section 8 has a pair of crimping tabs !3 which are made larger than the crimping tabs 12.

The insulator block 4 has a rectangular form to be fitted in the contact support section 6. Alternatively, the contact support section 6 and the insulator block 4 may be cylindrical.

In FIG. 3, the signal line contact 5 has a cylindrical contact proper !4 and a U-shaped signal line terminal 15. The contact proper 14 is made in the form of a pin. The signal line terminal !5 has a pair of crimping tabs 15*a* forming a U-shaped cross section. The signal line contact 5 is fitted into the insulator block 4.

Figure 4:
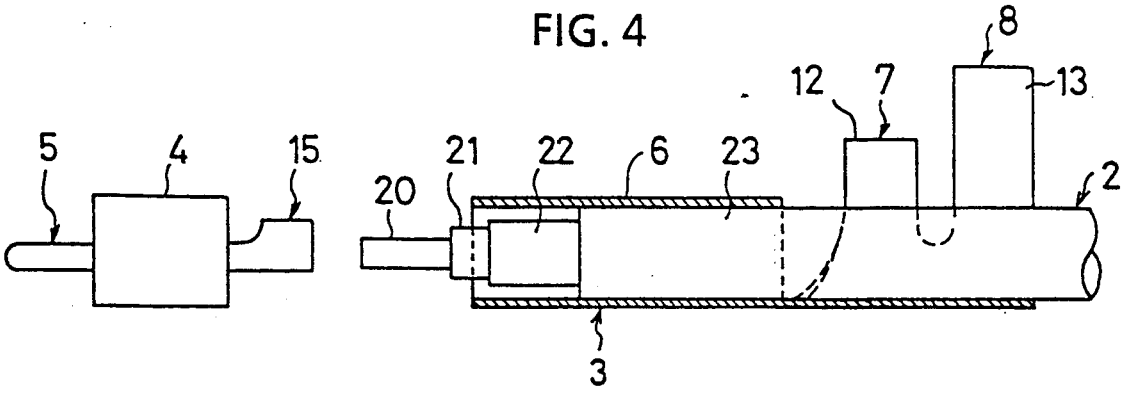
FIG. 4 is a side elevational view, partially in section, of the contact terminal before connection to a shielded cable.

To connect a shielded cable 2 to the contact terminal 1, the front portion of a shielded cable 2 is processed to expose the signal line (central conductor) 20, the intermediate insulator 21, the shield braid (outer conductor) 22 from the outer sheath 23 as shown in FIG. 2. The shielded cable 2 is then inserted through the shield jacket 3 so that the signal line 20 projects from the front end of the shield jacket 6 as best shown in FIG. 4. The signal line crimping section 15 of the signal line contact 5 is then crimped to the signal line 20 with the aid of a crimping punch, for example.

Figure 5:
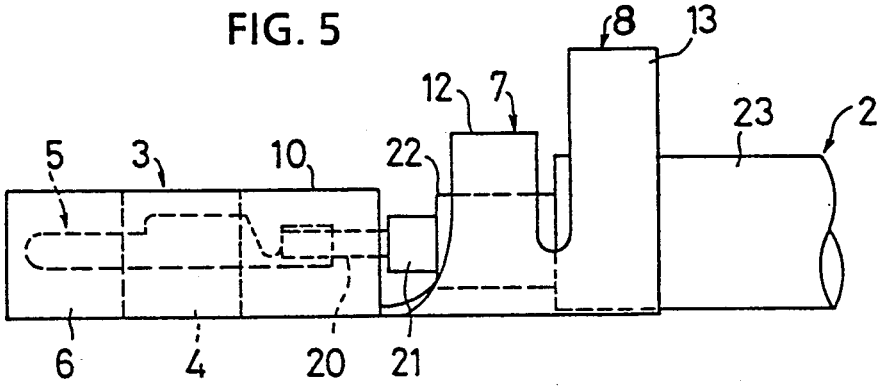
FIG. 5 is a side elevational view of the contact terminal after connection to the shield cable.
Figure 6:
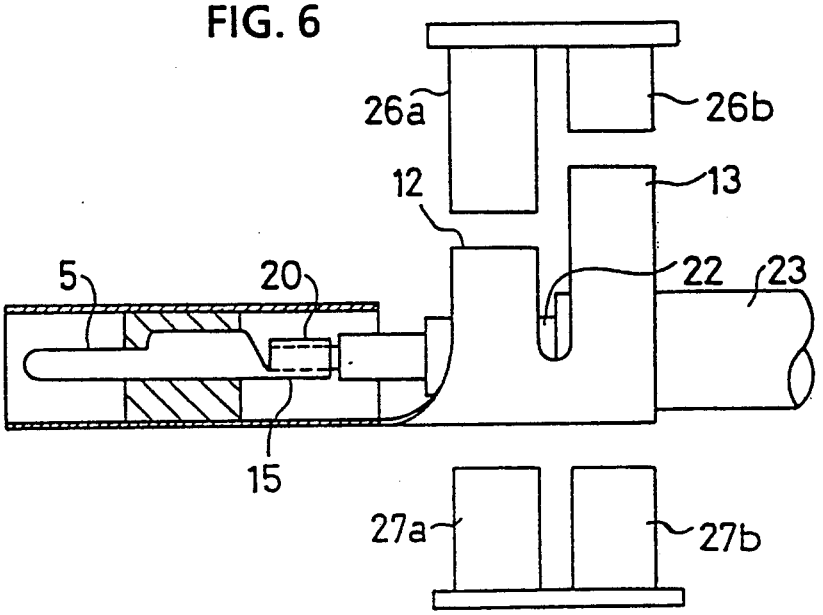
FIG. 6 is a side elevational view, partially in section, of the contact terminal useful for explaining how to connect the shield cable to the contact terminal.

Then, the shield jacket 3 is moved over the insulator block 4 as shown in FIG. 5. Then, crimper dies 26*a* and 26*b* and the crimping anvils 27*a* and 27*b* are used to crimp the crimping tabs 12 and 13 to the shield braid 22 and the outer sheath 23, respectively, whereby the contact terminal 1 is crimped to the shield cable 2. The contact terminal 1 is fixedly mounted in the housing D, providing a female connector B, which is connected to the male connector C for conducting electric current.

Since the signal line terminal 15 is crimped to the signal line 20 outside the shield jacket 6, it is possible to determine the width H of the shield jacket 6 regardless of the width of the crimping die 61. In addition, it is not necessary to provide any tool opening on the shield jacket so that the shield effect is improved near the connector proper.

We claim:

1. A miniature electrical contact terminal comprising:

a shield jacket having a contact support section, a shield braid crimping section with a pair of crimping tabs to be crimped to a shield braid of a shielded cable, and an outer sheath crimping section with a pair of crimping tabs to be crimped to an outer sheath of said shielded cable;

an insulator block to be fitted in said contact support section; and a signal line contact fitted through said insulator block such that a terminal section project from a rear end of said insulator block into a rear space which is defined by four side walls of said contact support section and said rear end of said insulator block;

said contact support section sufficiently long to completely cover said terminal section.

2. A method of connecting a shielded cable to a miniature electrical contact terminal of claim 1, which comprises the steps of:

inserting a stripped front portion of said shielded cable through said tubular contact support section of said shield jacket;

connecting said signal line to said terminal section of said signal line contact which has been put through said insulator block;

fitting said insulator block in said contact support section of said shield jacket; and crimping said shield braid crimping section and said outer sheath crimping section to a shield braid and an outer sheath of said shielded cable, respectively, whereby said shielded cable is connected to said miniature contact terminal.

* * * * *